US008011035B2

(12) United States Patent
Pizzi Spadoni

(10) Patent No.: US 8,011,035 B2
(45) Date of Patent: Sep. 6, 2011

(54) STRETCHER

(75) Inventor: Luigi Cesare Pizzi Spadoni, Collecchio (IT)

(73) Assignee: Spencer Italia S.r.l., Collecchio (Parma) (IT)

( * ) Notice: Subject to any disclaimer, the term of this patent is extended or adjusted under 35 U.S.C. 154(b) by 146 days.

(21) Appl. No.: 12/446,021

(22) PCT Filed: Oct. 19, 2007

(86) PCT No.: PCT/IB2007/003138

§ 371 (c)(1),
(2), (4) Date: Apr. 17, 2009

(87) PCT Pub. No.: WO2008/047226

PCT Pub. Date: Apr. 24, 2008

(65) Prior Publication Data

US 2010/0293712 A1 Nov. 25, 2010

(30) Foreign Application Priority Data

Oct. 20, 2006 (IT) ..... PR2006A0093

(51) Int. Cl.
*A61G 1/02* (2006.01)

(52) U.S. Cl. ..... 5/86.1; 5/611; 296/20

(58) Field of Classification Search ..... 5/611, 86.1; 296/20

See application file for complete search history.

(56) References Cited

U.S. PATENT DOCUMENTS

| | | | | |
|---|---|---|---|---|
| 5,913,559 | A * | 6/1999 | Sexton et al. | 296/20 |
| 6,526,611 | B2 * | 3/2003 | Flynn et al. | 5/611 |
| 6,701,545 | B1 * | 3/2004 | Ferneau et al. | 5/86.1 |
| 7,131,151 | B2 * | 11/2006 | Ferneau et al. | 5/86.1 |
| 7,540,547 | B2 * | 6/2009 | Lambarth et al. | 296/20 |
| 7,617,549 | B2 * | 11/2009 | Pollock | 5/86.1 |
| 7,631,373 | B2 * | 12/2009 | Broadley et al. | 5/86.1 |
| 2004/0034935 | A1 | 2/2004 | Ferneau et al. | |
| 2005/0229312 | A1 | 10/2005 | Bishop | |
| 2007/0000057 | A1 * | 1/2007 | Ward | 5/611 |

FOREIGN PATENT DOCUMENTS

| | | |
|---|---|---|
| EP | 1 738 732 | 1/2007 |
| WO | 2004/064698 | 8/2004 |

OTHER PUBLICATIONS

International Search Report dated Mar. 19, 2008, from corresponding PCT application.

* cited by examiner

*Primary Examiner* — Michael Trettel
(74) *Attorney, Agent, or Firm* — Young & Thompson

(57) ABSTRACT

The invention finds application in the field of ambulance transport, emergency transport and other transport equipment. It relates to a stretcher (1) of the type comprising an upper frame (2) with a articulated platform (3) mounted thereto; a from loading carriage (4). The stretcher (1) has at least one additional rear leg (9) and a corresponding support (10) for holding said rear leg (9) against the upper frame (2), in such a manner as to be suspended between the front loading carriage (4) and the additional rear leg (9) during loading and unloading. The provision of a motor-driven coupling system/device allows automatic loading and unloading of said stretcher (1).

12 Claims, 13 Drawing Sheets

STRETCHER

The present invention relates to a stretcher, e.g. for use in ambulances, funeral transport, or elsewhere.

BACKGROUND OF THE INVENTION

Self-loading ambulance stretchers have a platform on which the patient is laid, and a frame for supporting said platform, which in turn has legs with free wheels for transfer thereof.

As the stretcher is loaded onto the ambulance, the operator has to push it along the ambulance floor, wherefore the legs have to be somehow folded against the frame; this can be accomplished manually (according to a rather obsolete practice), or using special arrangements, such as hinging the legs under the floor for later unlocking thereof towards the floor by suitable hydraulic or mechanical or electric devices as the stretcher is pushed by the operator.

In another type of stretcher the wheels are mounted to a lower frame, which is connected to the upper frame, the platform being fixed thereto by one or more scissor-lift systems: thus, the loading step is carried out by laying the front of the stretcher, usually equipped with additional wheels, on the ambulance floor and by causing the stretcher to collapse by folding the above mentioned scissor-lift, i.e. by lifting the lower frame against the upper frame until the free wheels of the lower frame are flush with the ambulance frame, whereby the operator can push the collapsed stretcher into the ambulance.

Concerning this action, a major drawback arises in that at least two operators are needed, with the former holding one end of the stretcher (the other end already lying by suitable front loading wheels on the ambulance floor), and the latter moving the lower frame towards the main frame, thereby folding the scissor-lift system. The same drawback arises when the stretcher has to be unloaded from the ambulance.

Furthermore, while one operator operates the scissor-lift, the other has to support the combined weight of the stretcher and the patient lying thereon, and with time this may cause the operator to suffer pain o injury.

SUMMARY OF THE INVENTION

The object of the present invention is to allow loading and unloading of stretchers of the type using scissor-lift systems, by one operator, by the provision of an additional wheel behind the stretcher which is designed to support the stretcher end, by suitable means, while the operator folds the scissor-lift system The advantages achieved by such invention consist in that one operator can handle the whole transport operation, and is not required to support the weight of the person to be loaded during loading and unloading.

In other words, the invention can considerably reduce the load on the operator and any risk that he/she may suffer injury as a result of the above operation.

These objects and advantages for patient and operator safety are achieved by the stretcher of this invention, which is characterized by the content of the annexed claims.

BRIEF DESCRIPTION OF THE DRAWINGS

These and other features will be more apparent from the following description of a few embodiments, which are shown by way of example and without limitation in the accompanying drawings, in which.

DETAILED DESCRIPTION OF THE PREFERRED EMBODIMENTS

Figure 1:
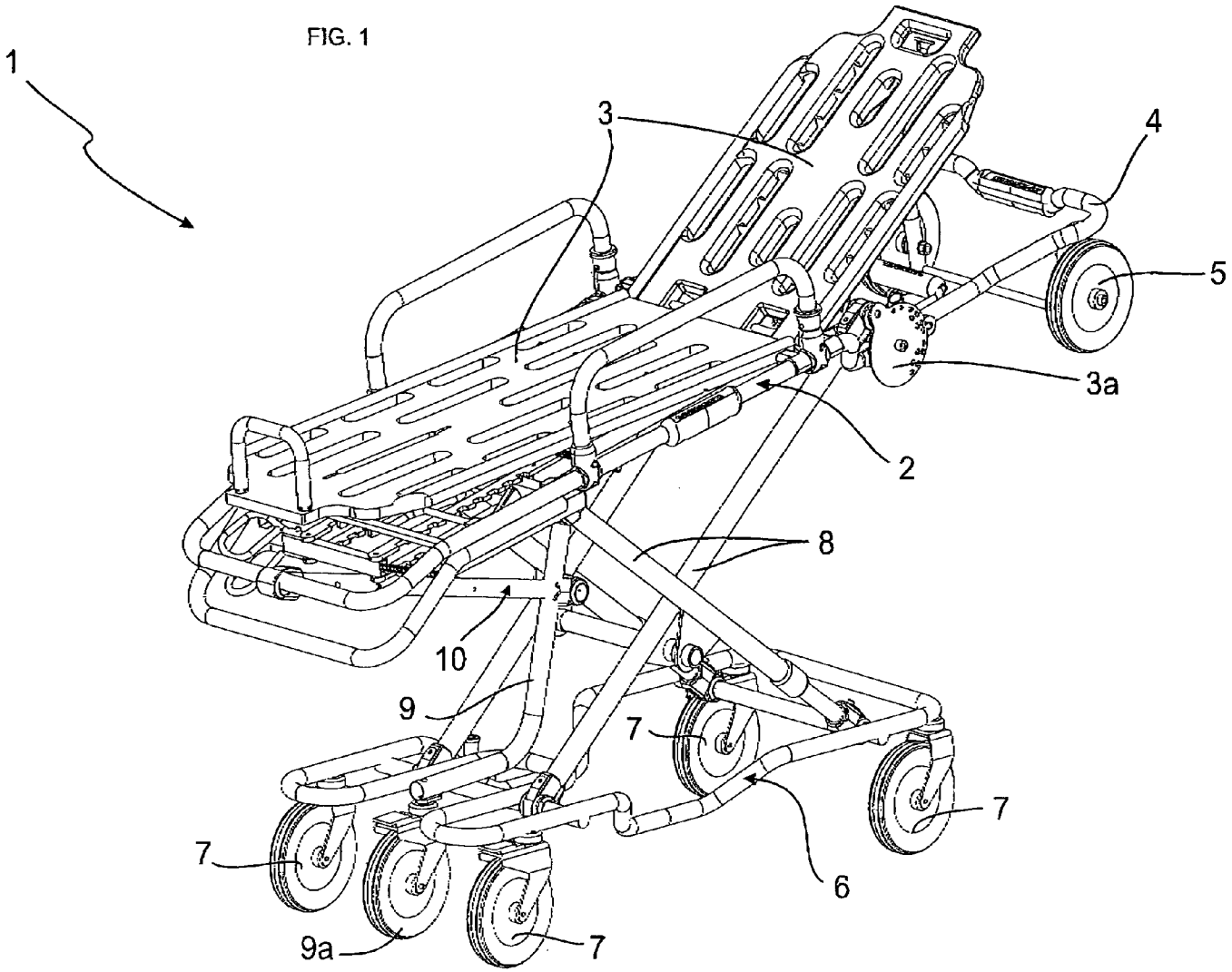
FIG. 1 is a perspective view of the stretcher of this invention.

Referring to FIG. 1, numeral 1 generally designates a stretcher comprising an upper frame 2 with an articulating, i.e. tiltable platform 3 mounted thereto.

A front loading carriage 4 is fixed to the upper frame 2, and its tilt relative to the upper frame 2 can be adjusted by a suitable adjustment disk 3*a* or any other equivalent system.

A pair of free wheels 5 is attached to said front loading carriage 4, for supporting the stretcher 1 on the ambulance floor during loading.

The lower frame 6 is also shown to have four free wheels 7, and to be connected with the upper frame through a scissor-lift 8, substantially formed of two cylinders in crossed relationship, attached to the respective frames 2 and 6. A rod may slide in these cylinders so that, by lifting the lower frame 6, or by controlling the rod motion in the cylinder, the scissor-lift 8 collapses and the frames 2 and 6 move towards each other, thereby reducing the height of the stretcher without changing the position of the free wheels 7.

Once the lower frame 6 comes close to the upper frame 2, it may be optionally locked thereto by suitable locking means.

The stretcher 1 further has an additional rear loading leg 9 in hinged relationship with the upper frame under the platform 3.

Figure 3:
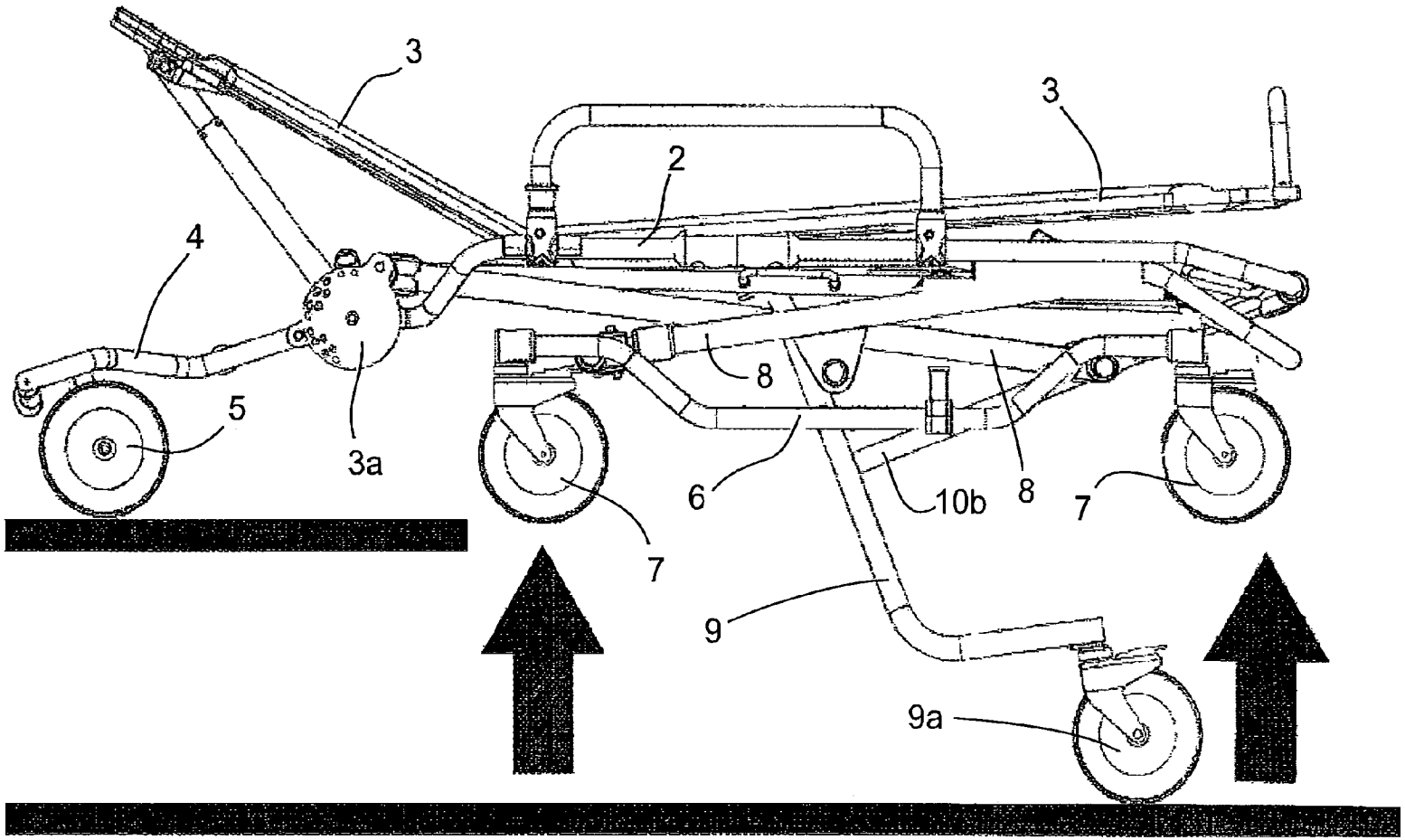
FIG. 3 illustrates the second step for loading the stretcher of FIG. 1 onto an ambulance.
Figure 4:
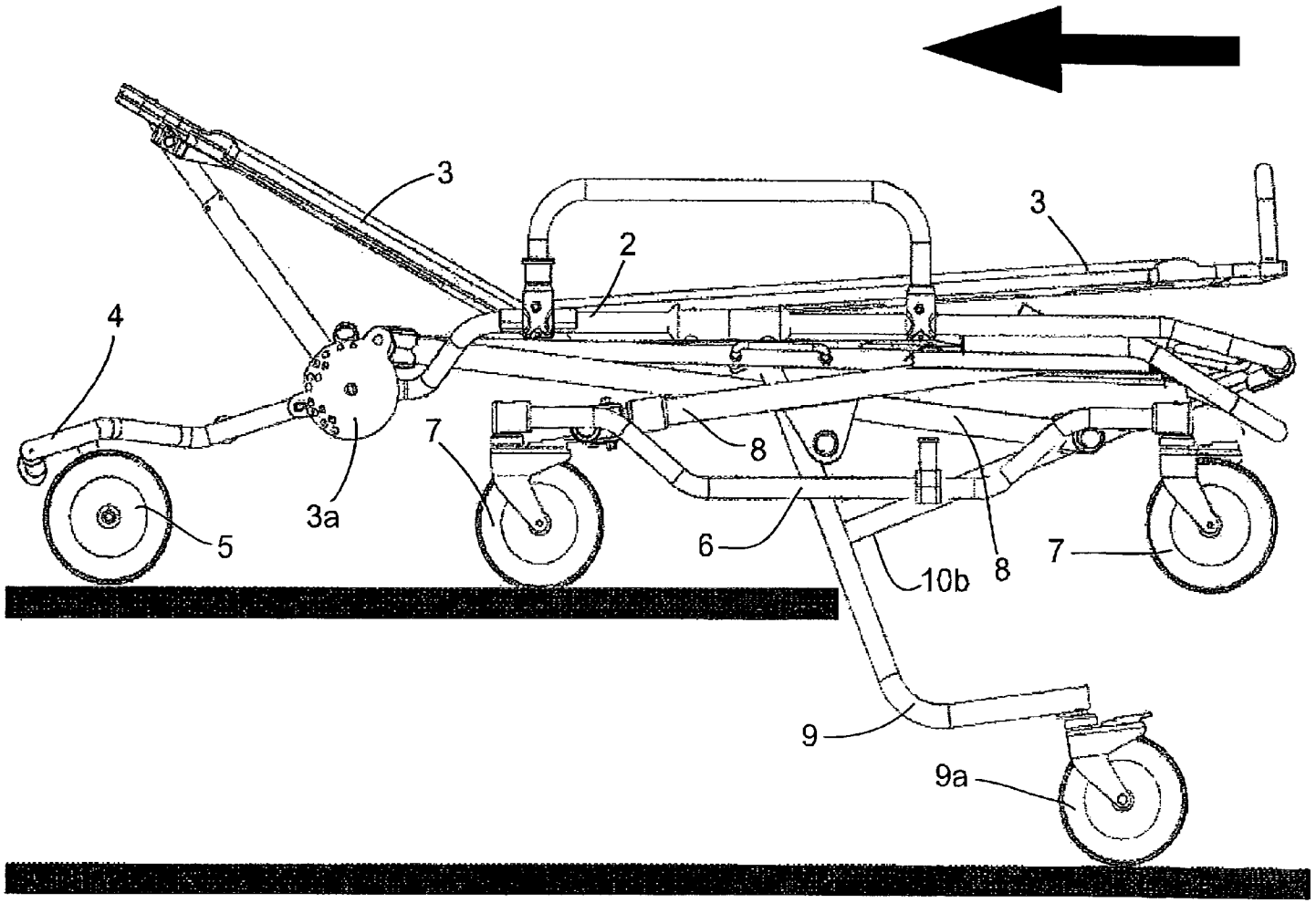
FIG. 4 illustrates the third step for loading the stretcher of FIG. 1 onto an ambulance.
Figure 5:
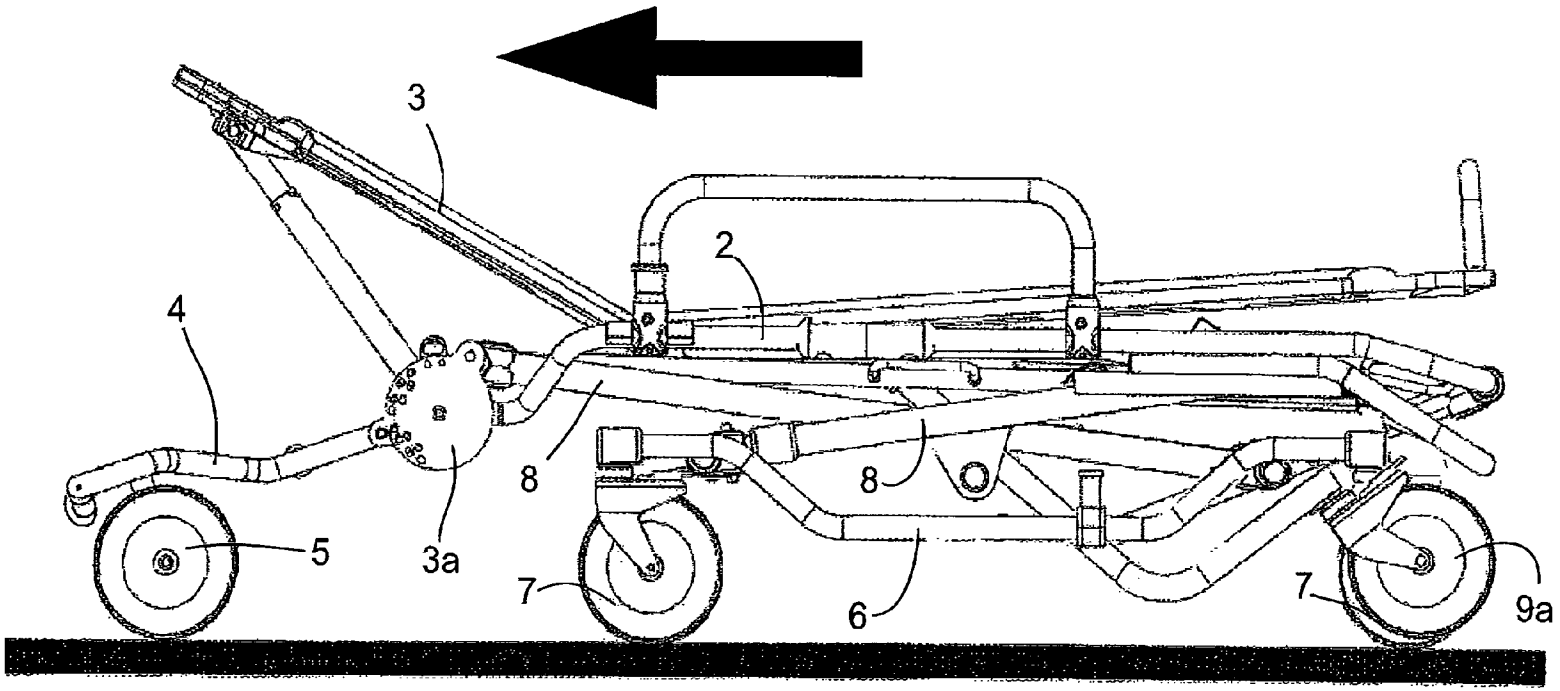
FIG. 5 illustrates the fourth step for loading the stretcher of FIG. 1 onto an ambulance.
Figure 6:
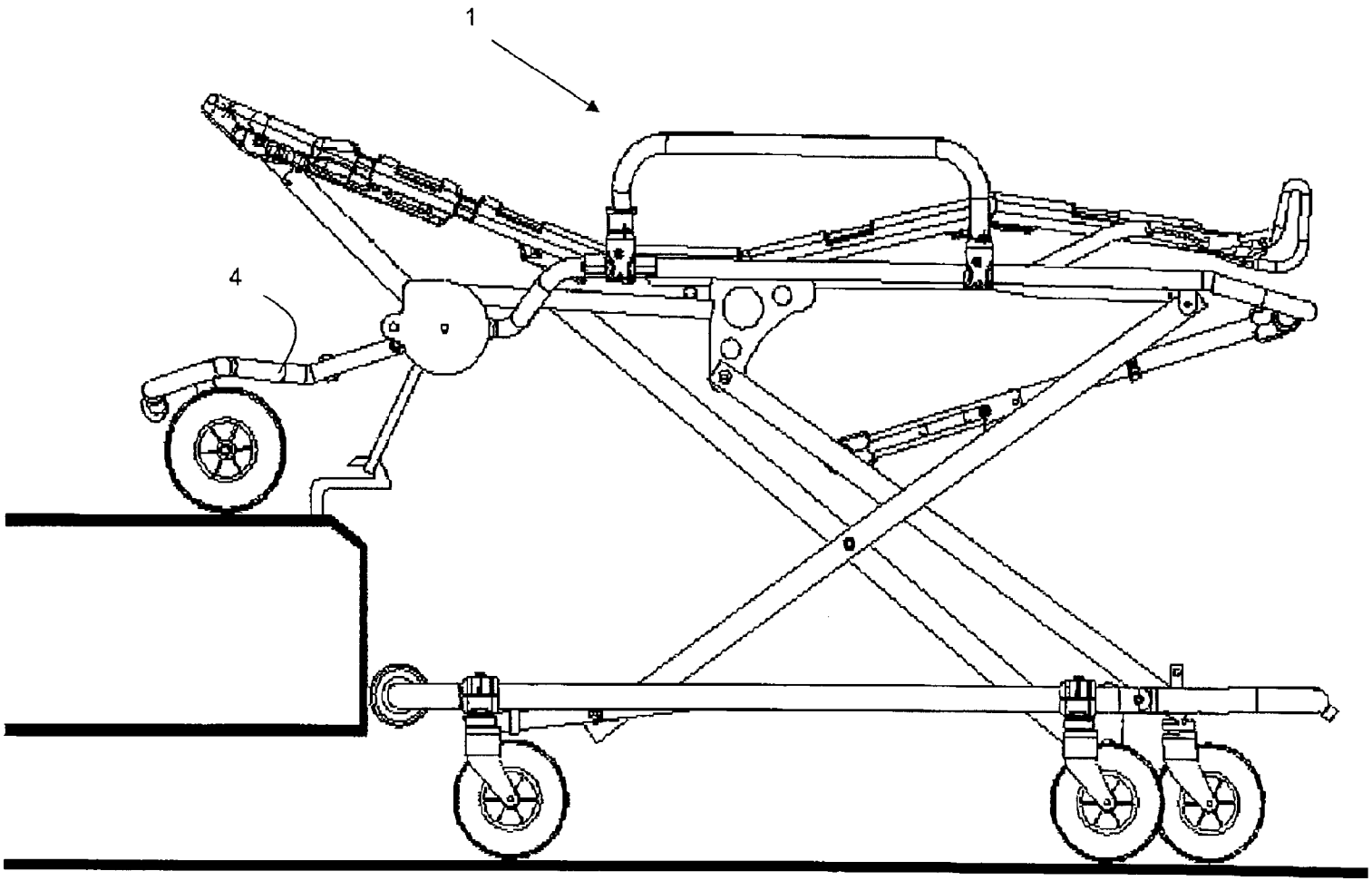
FIGS. 6, 7, 8, 9, 10, 11, 12 and 13 illustrate an alternative solution to the loading and unloading of the present stretcher, in which a motor-driven coupling system is provided on the floor of the loading means, such as the ambulance.
Figure 7:
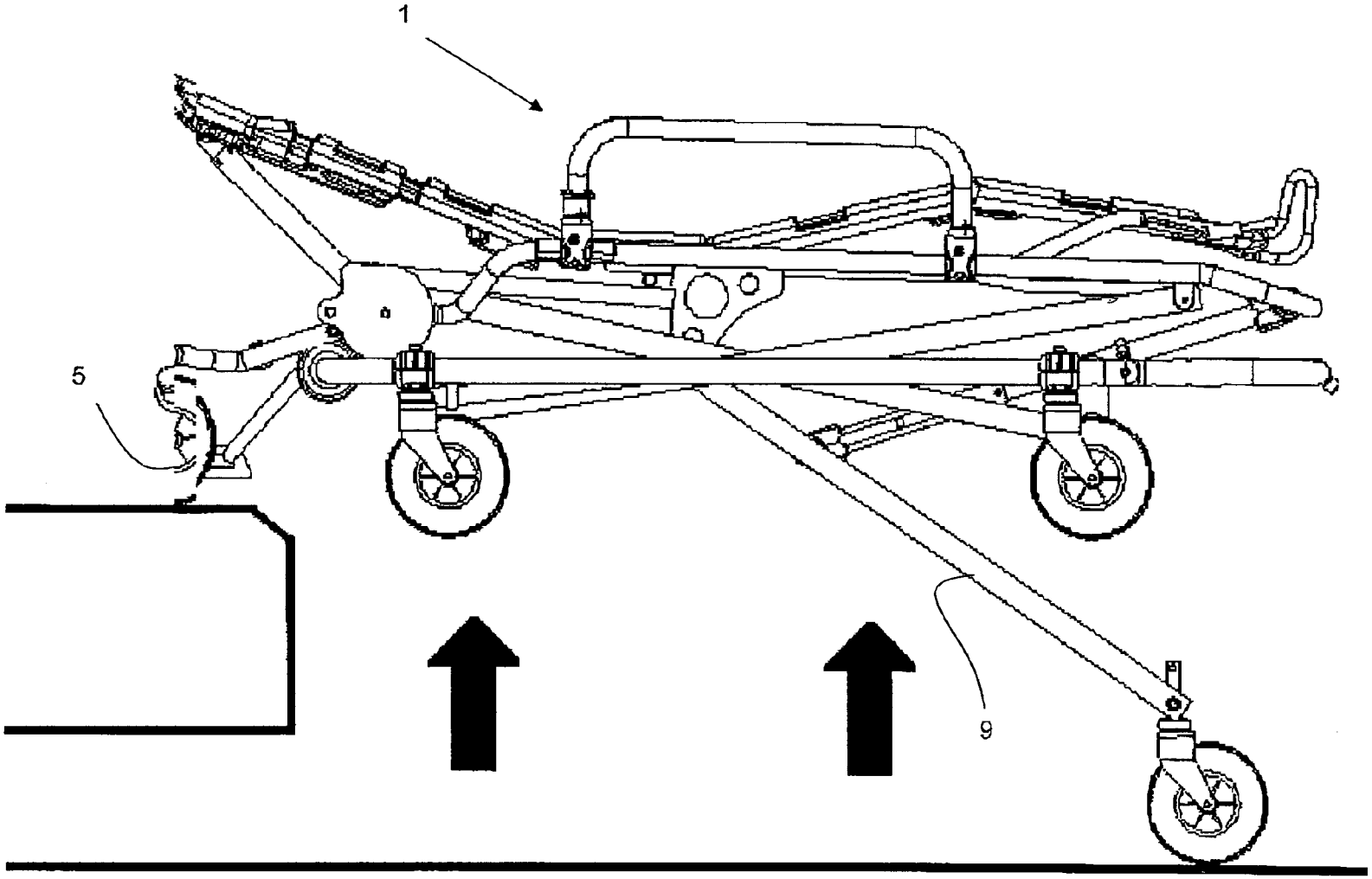
Figure 8:
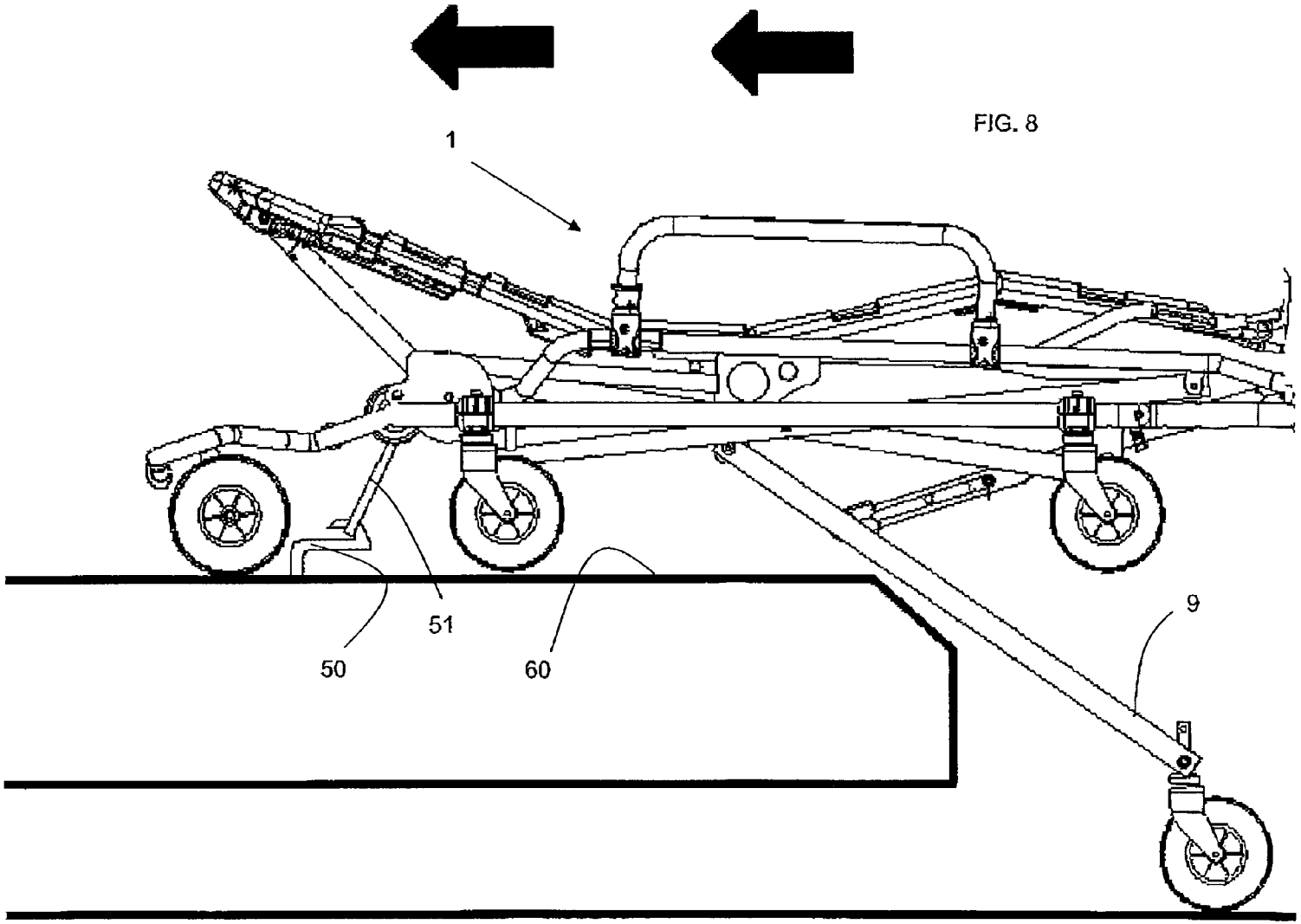
Figure 9:
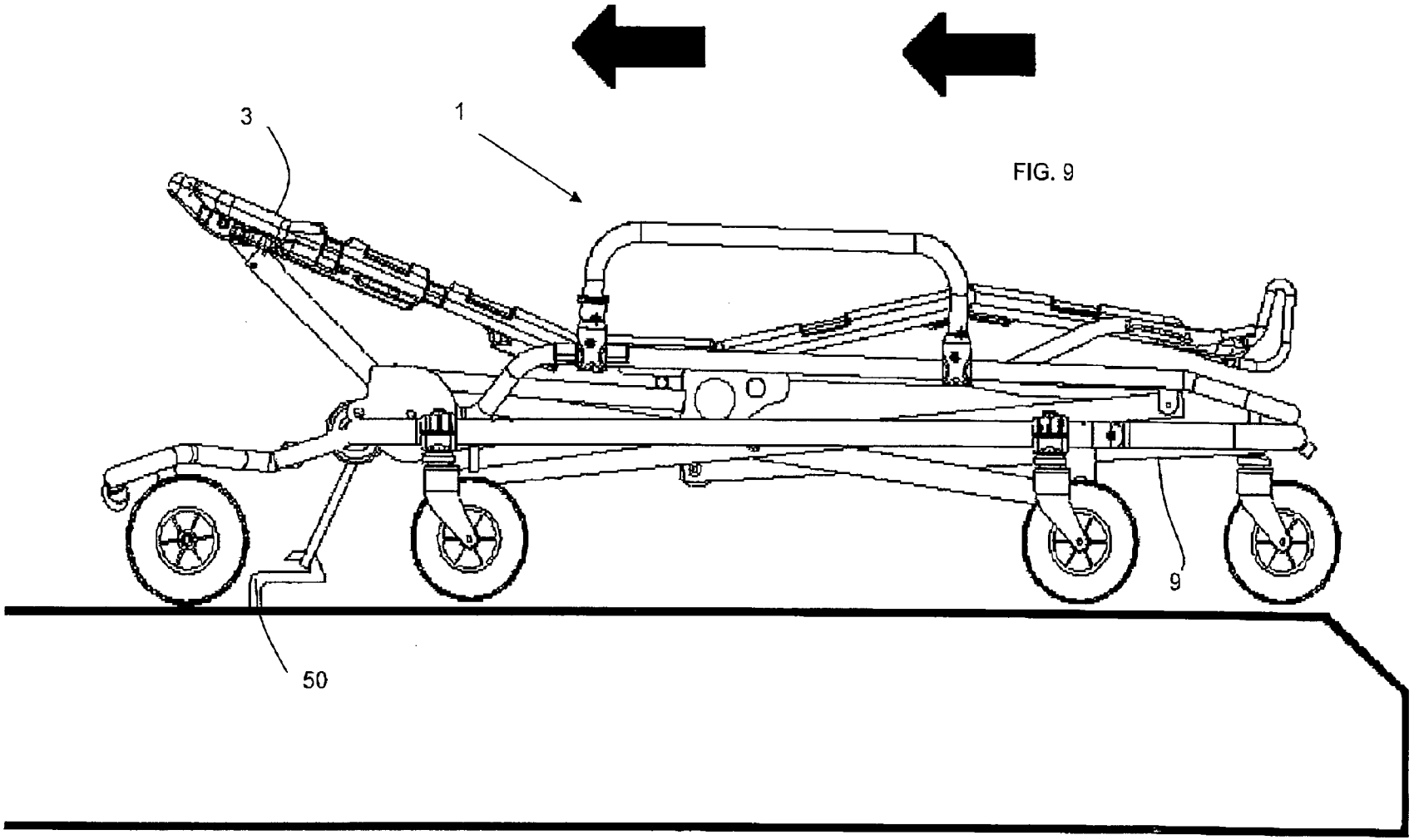
Figure 10:
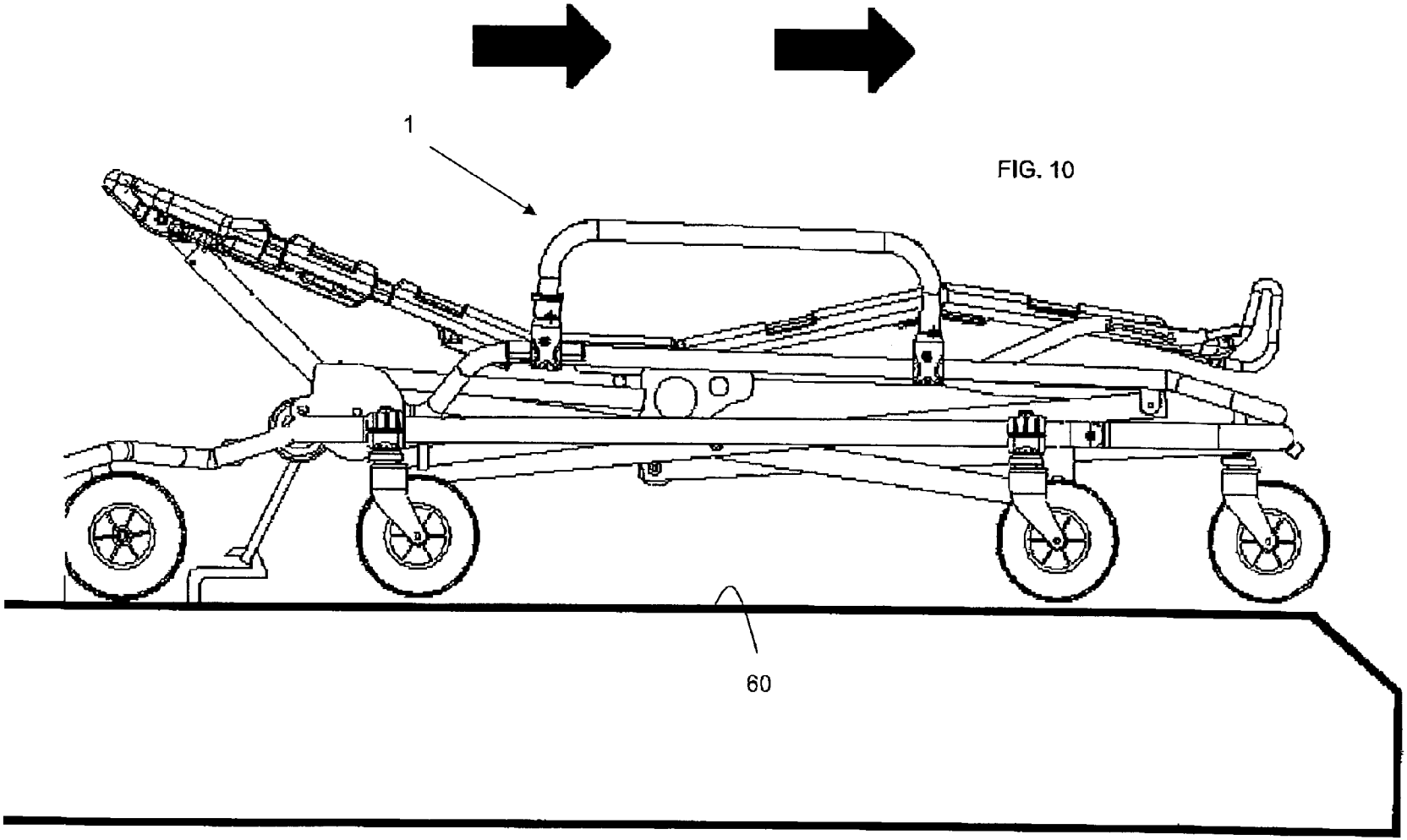
Figure 11:
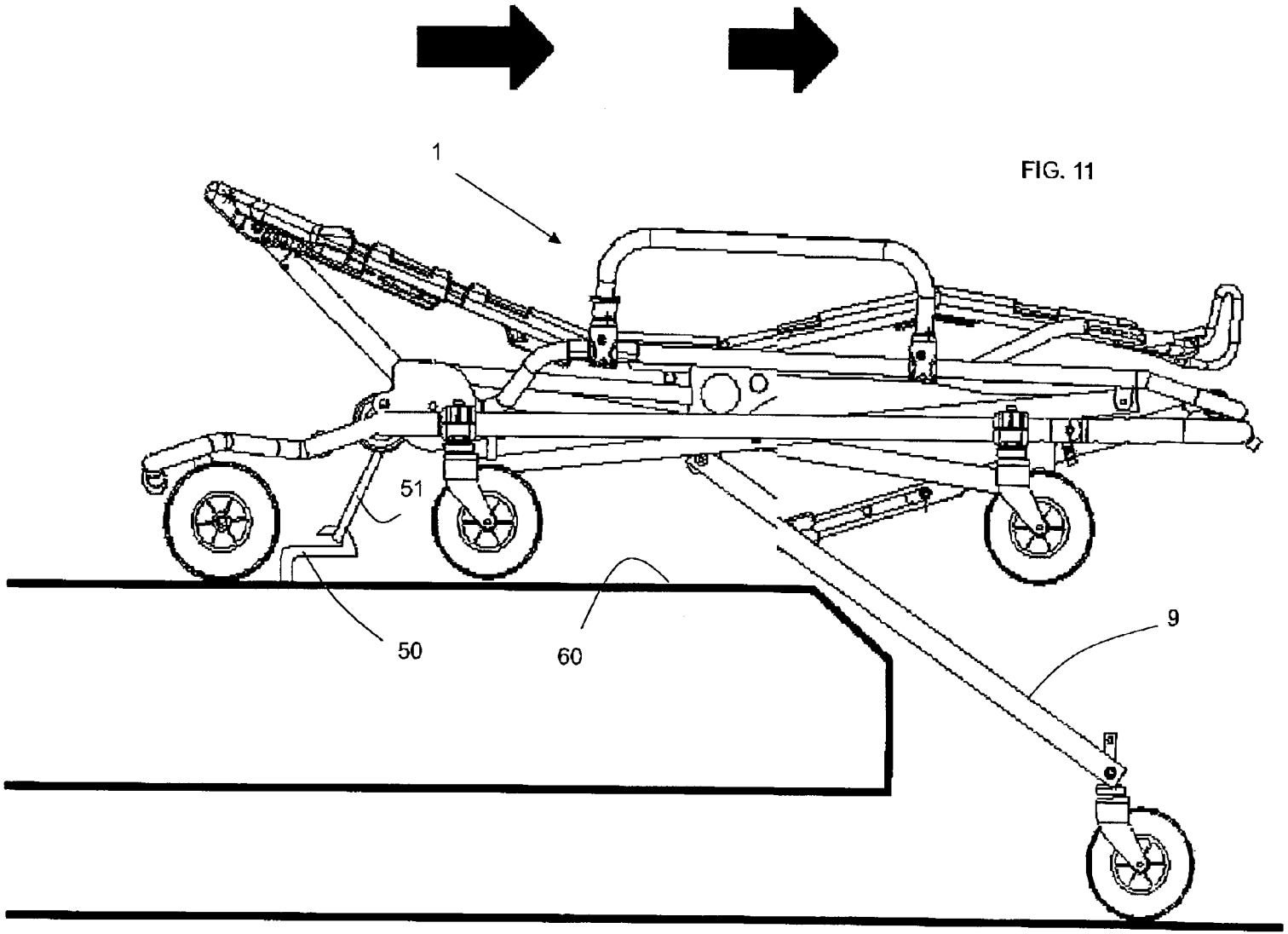
Figure 12:
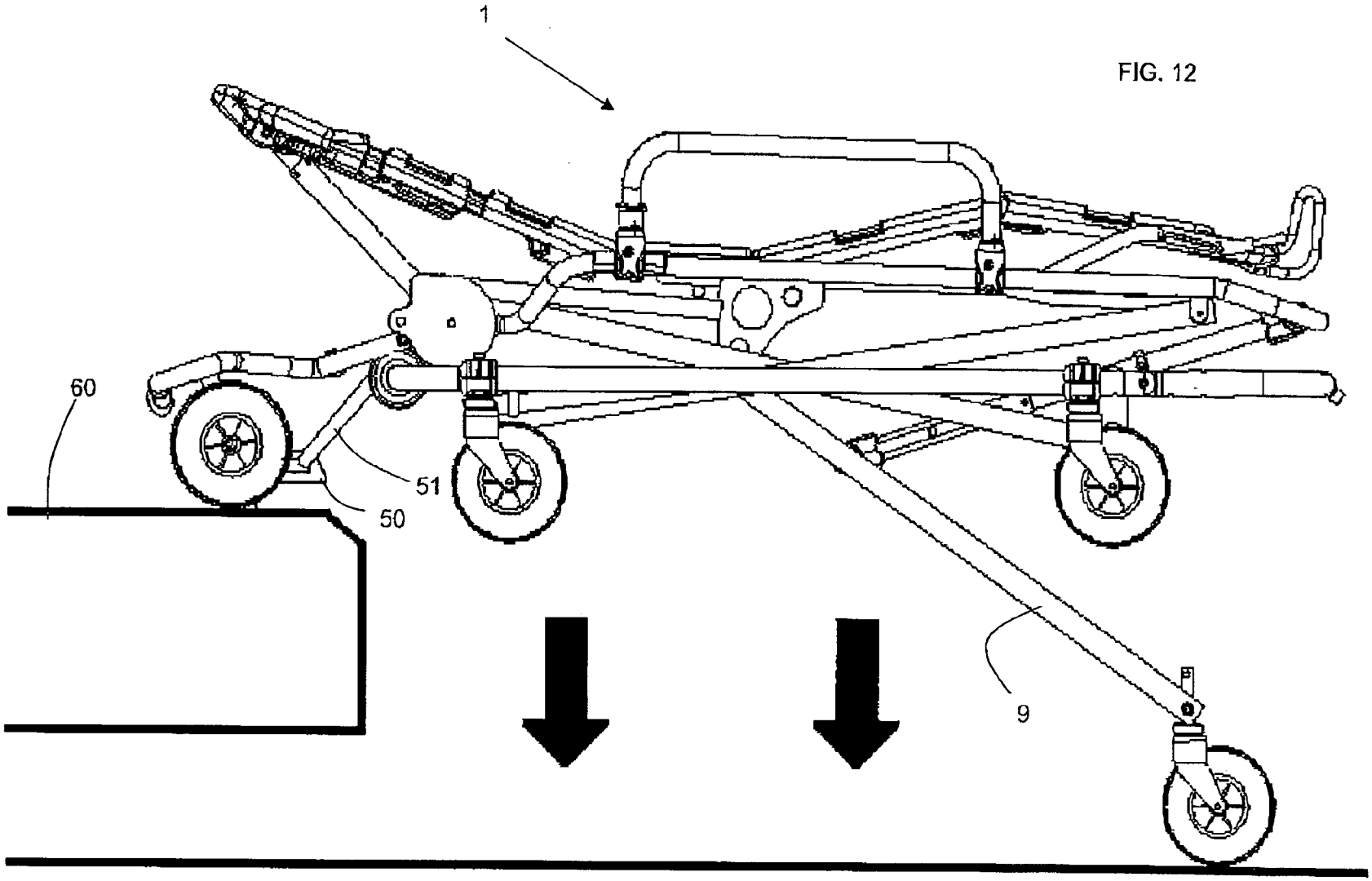
Figure 13:
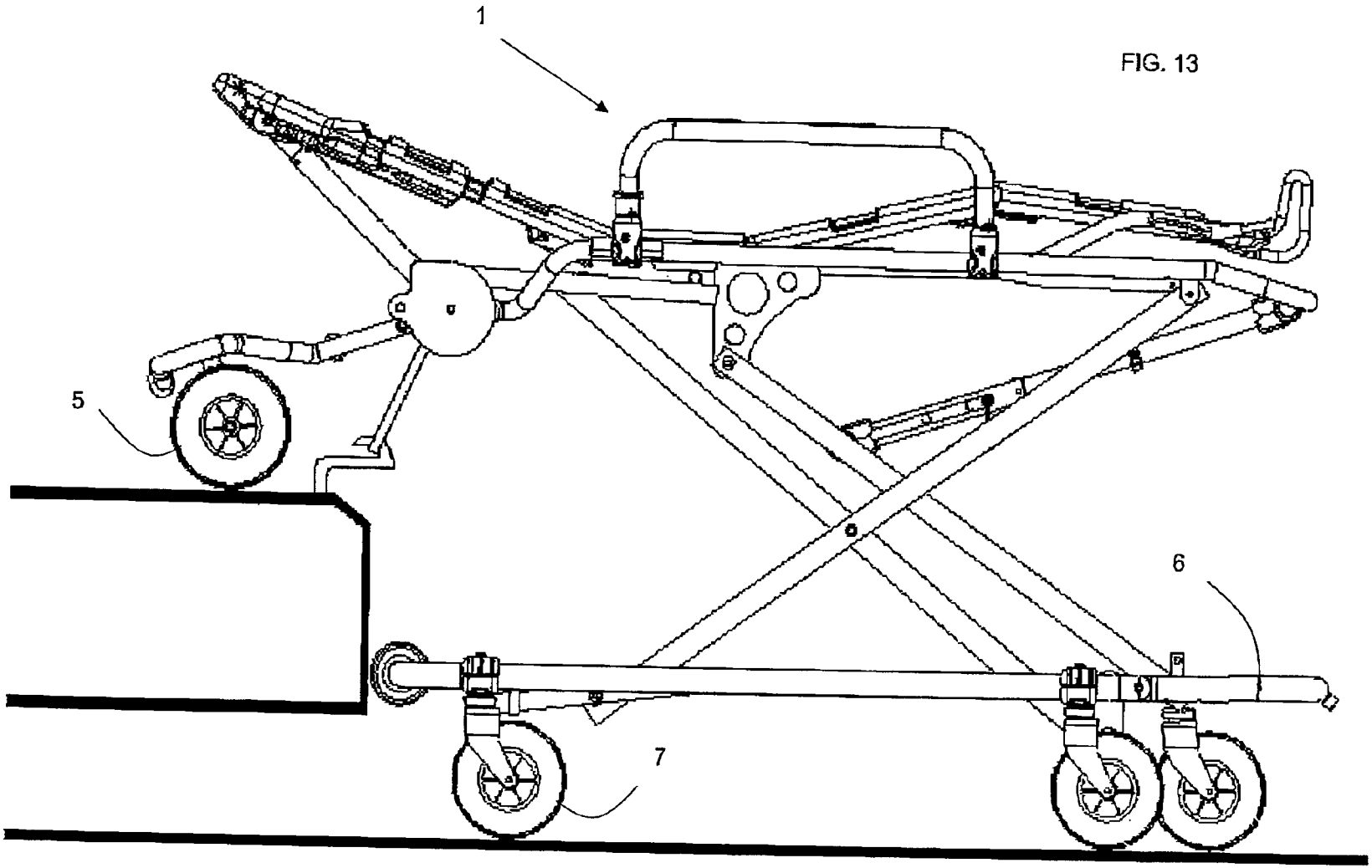

A support wheel 9*a* is fixed to the lower end of said rear loading leg 9 for supporting and transferring the stretcher 1 when the two lower and upper frames are closer together, as shown in FIG. 3.

A locking system 10 joins said rear loading leg 9 to the frame 2, at the crossmember placed on the push side of the stretcher 1.

Figure 2:
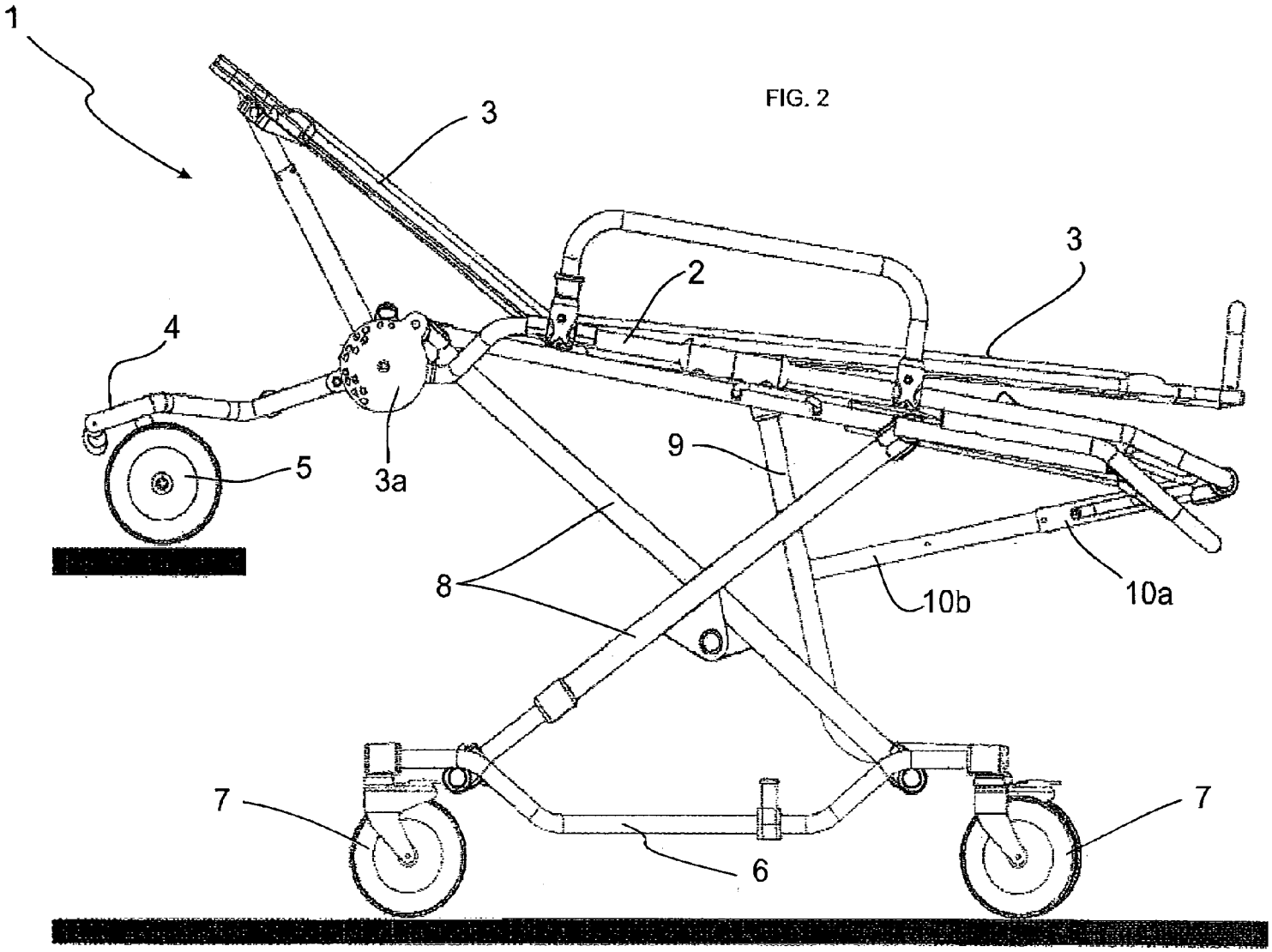
FIG. 2 illustrates the first step for loading the stretcher of FIG. 1 onto an ambulance.

As better shown from FIG. 2 and the following Figures, said locking system 10 is practically composed of a cylinder 10*a* in which a rod 10*b* slides as the rear leg moves up.

Indeed, the locking system 10 has the function to lock the rear loading leg 9 to the ground for the stretcher 1 to be only suspended between the front loading carriage 4 and the rear loading leg 9, which allows operation on the lower frame 6, and displacement thereof against the upper frame 2 during loading in and unloading from the ambulance.

The rod 10*b* and the cylinder 10*a* are locked together by suitable lock means, of the manual, mechanical, hydraulic or electric type.

Referring to FIGS. 2, 3, 4 and 5, there are shown the steps to be carried out for loading the stretcher 1 of this invention onto the ambulance floor.

First, the front loading carriage 4 is laid on such floor whereupon, as the stretcher is lowered, the locking system 10 with its lock means is moved close to the stretcher 1 and lifts the lower frame 6 thereby folding the scissor-lift 8: thus 1 the stretcher is in equilibrium between said front loading carriage 4 and the additional rear support leg 9.

Then the operator effortlessly pushes the stretcher 1 in the above configuration into the ambulance: obviously, for the rear leg 9 to fold against the upper frame 2, the locking system 10 shall be first unlocked.

An inverse procedure shall be followed to unload the stretcher 1 from the ambulance.

The additional rear leg 9 may be also fixed to a crossmember of the frame 2 beneath the platform 2 and two rear legs can be also fixed to the stretcher 1 using a scissor-lift system, without departure from the scope of the present invention.

Particularly referring to FIGS. 6, 7, 8, 9, 10, 11, 12 and 13, there is shown an alternative solution for loading the stretcher 1.

A hook-like coupling system/device 50 is shown, which projects out of the floor 60 and engages with a corresponding loop formed on an extension 51 of the stretcher 1.

Thanks to this motor-driven device 50, the stretcher 1 is first coupled thereto (FIG. 6) and then conveniently rolled over the floor 60: at the same time, the rear leg 9 will stabilize the stretcher as described above.

The device 50 allows automatic or semiautomatic loading and unloading.

The device 50 may be a hook or an equivalent means attached to a pull rope.

The stretcher 1 of the above example includes mechanical, electro-mechanical, pneumatic or hydraulic means for folding or opening the scissor-lift 8 and moving the frames 2 and 4 close to or apart from each other.

The invention claimed is:

1. A stretcher (1) for ambulances, comprising:

an upper frame (2) with a platform (3) mounted thereto;

a front loading carriage (4) fixed to the upper frame (2) via an adjustment means for adjusting a tilt of the front carriage (4) relative to the upper frame (2), the front loading carriage having a pair of loading wheels (5) mounted thereto;

a lower frame (6) with free transfer wheels (7) mounted thereto;

a scissor-lift (8) that connects said lower frame (6) to the upper frame (2);

means for locking the lower frame (6) to the upper frame (2); and a rear loading leg (9) in hinged relationship with the upper frame under the platform (3); and a locking system (10) joining said rear loading leg (9) to the upper frame (2) at a crossmember located at a push side of the stretcher (1), said locking system (10) comprising a rod (10*b*) configured to slide in a corresponding cylinder (10*a*) for locking the rear loading leg (9) to the ground such that the stretcher (1) is suspended only by way of the front loading carriage (4) and the rear loading leg (9) to allow operational displacement of the lower frame 6 against the upper frame 2 during loading and unloading of said stretcher with the ambulance, wherein the rod (10*b*) and the cylinder (10*a*) are lockable by way of a locking mechanism selected from the group consisting of manual, mechanical, hydraulic or electric type.

2. The stretcher (1) for ambulances as claimed in claim 1, further comprising:

any of mechanical, electro-mechanical, pneumatic or hydraulic means for folding and opening the scissor-lift (8) for moving the frames (2,6) to be either of close to or apart from each other.

3. The stretcher (1) for ambulances as claimed in claim 1, further comprising:

an extension (51) with a loop engageable with a motor-driven coupling device (50) projecting out of a floor (60) of the ambulance so that the stretcher (1) may be coupled thereto to be rolled over the floor (60).

4. The stretcher (1) for ambulances as claimed in claim 1, wherein the adjustment means is an adjustment disk (3*a*).

5. The stretcher (1) for ambulances as claimed in claim 1, wherein the platform (3) mounted to the upper frame (2) is tiltable.

6. A stretcher, comprising:

a platform;

an upper frame extending from a front end to a rear end, said platform being mounted upon said upper frame;

a front loading carriage fixed to the front end of said upper frame;

a lower frame with free transfer wheels mounted thereto;

a collapsible scissor-lift connecting said lower frame to said upper frame, said scissor-lift configured to maintain a spacing between said lower frame and said upper frame in a first mode, and further configured to bring said lower frame and said upper frame together in a collapsed second mode; and a rear loading leg connected via a locking system to said upper frame and configured to move independently of said scissor lift, said locking system in an extended mode configured to hold said rear loading leg in an extended position so that said stretcher is suspended from the ground via said front loading carriage and said rear loading leg when said scissor-lift is in the collapsed second mode, and said locking system in a folded mode configured to position said rear loading leg against said upper frame.

7. The stretcher as claimed in claim 6, wherein said front loading carriage is fixed to the front end of said upper frame via an adjustment means for adjusting a tilt of said front carriage relative to said upper frame.

8. The stretcher as claimed in claim 7, wherein the adjustment means is an adjustment disk.

9. The stretcher as claimed in claim 6, further comprising:

means for locking said lower frame to said upper frame in the collapsed second mode.

10. The stretcher as claimed in claim 6, wherein said locking system joins said rear loading leg to said upper frame at a crossmember located at the rear end.

11. The stretcher as claimed in claim 6, wherein said locking system in the folded mode beings a free end of said rear loading leg toward the rear end.

12. The stretcher as claimed in claim 6, further comprising:

an extension at the front end with a loop configured to be coupled with a motor-driven coupling device for pulling the stretcher.

* * * * *